United States Patent [19]

Gosch et al.

[11] Patent Number: 4,901,436

[45] Date of Patent: Feb. 20, 1990

[54] SHUTTER FOR A DRY-SHAVING APPARATUS AND METHOD OF MANUFACTURING A SHUTTER

[75] Inventors: Peter Gosch; Albert Klemen; Arno Wolfger, all of Klagenfurt, Austria

[73] Assignee: U.S. Philips Corp., New York, N.Y.

[21] Appl. No.: 184,310

[22] Filed: Apr. 21, 1988

[30] Foreign Application Priority Data

Apr. 24, 1987 [AT] Austria ..... 1025/87

[51] Int. Cl.[4] ..... B26B 19/02

[52] U.S. Cl. ..... 30/43.92; 160/231.2

[58] Field of Search ..... 30/32, 34 R, 43, 43.91, 30/43.92, 90; 160/201, 230, 230.1, 230.2

[56] References Cited

U.S. PATENT DOCUMENTS 2,690,216 9/1954 Scott ..... 160/231.2 X 3,645,597 2/1972 Sakow ..... 160/231.2 X

FOREIGN PATENT DOCUMENTS 1122410 1/1962 Fed. Rep. of Germany ..... 30/34 R

*Primary Examiner*—Douglas D. Watts

*Attorney, Agent, or Firm*—Ernestine C. Bartlett

[57] ABSTRACT

In a shutter (3) for a dry-shaving apparatus, which shutter serves for optinally covering or exposing a shear foil of said apparatus and which comprises an elastic carrier (11) and spaced-apart slats (10), the inherently stiff slats, viewed in the longitudinal direction of the shutter, are successively enveloped at least partly by the elastic carrier (FIG. 1 and FIG. 5). Two-step injection moulding processes are proposed for manufacturing such a shutter.

17 Claims, 4 Drawing Sheets

SHUTTER FOR A DRY-SHAVING APPARATUS AND METHOD OF MANUFACTURING A SHUTTER

BACKGROUND OF THE INVENTION

The invention relates to a shutter for a dry-shaving shaving apparatus on which it is longitudinally slidable for optimally covering or exposing a shear foil of said apparatus, which shutter comprises an elastic carrier and spaced-apart slats and can be guided laterally at both sides in groove-shaped guides provided on the dry-shaving apparatus. A shutter of this type, known from DE AS 11 22 410, comprises a foil provided with spaced-apart slats which extend across the central area of the foil and which do not cover the lateral edge portions of the foil with which the shutter is laterally guided at both sides in grooves formed in the dry-shaped apparatus.

SUMMARY OF THE INVENTION

It is an object of the invention to construct a shutter of the type defined in the opening sentence in such a way that it has a stable overall structure, combining a high stability in the transverse direction with a satisfactory flexibility in the longitudinal direction to adapt itself to the shape of a shear foil which may have a comparatively sharp curvature. According to the invention this is achieved in that, viewed in the longitudinal direction of the shutter the inherently stiff slats are successively enveloped at least partly by the elastic carrier. In this way the inherently stiff slats are firmly and reliably connected to the carrier, thereby ensuring a satisfactory stability of the shutter in the transverse direction. The portions of the elastic carrier between the spaced-apart slats then provide the flexibility of the shutter in the longitudinal direction.

Another object of the invention is the provision of a simple method for the manufacture of shutters of the invention in mass-production quantities.

It is found to be very advantageous if viewed in the longitudinal direction of the shutter the slats are successively enveloped by the carrier in a measuring pattern at sides adjoining each other in a U-shape, the portions of the carrier between the spaced-apart slats being formed as articulate thin portions of the integral-hinge type. When the slats are thus partly enveloped by the carrier this provides a reliable connection of the slats to the carrier in addition to a high flexibility of the shutter in the longitudinal direction.

In this respect it is further found to be advantageous if the slats are enveloped by the carrier in a meandering pattern at least over their full height. This results in a very reliable connection of the slats to the carrier.

In this respect it is further found to be advantageous if at the side where the slats are free from the U-shaped envelopment by the carrier, the carrier comprise at least one continuous rib which extends in the longitudinal direction of the shutter. In this way the carrier partly encloses the slats at both sides, resulting in a further improvement of the connection of the slats to the carrier.

In this respect it is also found to be advantageous if the ribs engages in groove-shaped recesses formed in the free sides of the slats. In this way the slats are anchored to the rib of the carrier, resulting in a further improvement of the connection of the slats to the carrier.

It is also found to be advantageous if, viewed in the longitudinal direction of the shutter, the slats are enveloped completely by the carrier, the portions of the carrier between the spaced-apart slats being formed as articulate thin portions of the integral-hinge type. In this way the slats are inseparably attached to the carrier, the carrier portions between the slats guaranteeing the longitudinal flexibility of the shutter.

It is also found to be advantageous if, viewed in the longitudinal direction of the shutter, the slats are enveloped completely by the carrier and the carrier is constructed as a strip having flat wall surfaces. Although the slats are also inseparably connected to the carrier, the carrier now has flat wall surfaces, which is advantageous for the slidability and the appearance of the shutter It is found to be very advantageous if the slats extend across the full width of the shutter and at their ends comprise stiff lateral projections with which the shutter can be guided laterally at both sides in groove-shaped guides on the dry-shaving apparatus. This results in a very good guidance of the shutter because the projections which engage in the guides as well as the slats are inherently stiff and not compliant, the fact that said projections as well as the slats are spaced from one another also enabling guides which are curved as at the location of the shear foil to be readily followed by the shutter.

In this respect it is further found to be advantageous if the projections are L-shaped and project from the slats, transversely of the shutter. In this way the lateral guides for the shutter are offset from the actual shutter, so that the lateral parts of the dry-shaving apparatus in the shear-foil area, in which parts the guides for the shutter are formed, need not project above the shear foil and do not impair shaving by means of the dry-shaving apparatus.

In the case of slats which extend across the full width of the shutter it is also found to be advantageous if the ends of the slats are laterally enveloped at least partly by the carrier. This further improves the reliability of the connection between the slats and the carrier.

It is also found to be advantageous if, viewed in the longitudinal direction of the shutter, the last slat situated at one end of the shutter is constructed as a widened gripping element for moving the shutter. This ensures a simple and reliable operation of the shutter.

In this respect it is also found to be advantageous if the carrier which envelops the slat constituting a gripping element engages in lateral grooves formed in said slat and extending transversely of the slat. This results in a particularly reliable connection between the carrier and the slat constituting a gripping element, which connection is capable of taking up forces acting, in particular, in the sliding direction.

In this respect it is further found to be advantageous if the lateral grooves in the slat constituting a gripping element are undercut. This results in an even more reliable connection between the slat constituting a gripping element and the carrier.

The invention further relates to a method of manufacturing shutters in accordance with the invention. It is an object of the invention to provide very simple methods which are also suitable for the manufacture in mass-production quantities. According to the invention the slats and the carrier are therefore manufactured in a two-step injection-molding process, the slats being formed in the first process step and the carrier being formed in the second process step. The use of a two-step injection-molding process, as known per se, yields the advantage that the slats formed in the first process step can remain in a mold section for the first process step, which is also used in the second process step. As a result of this, the slats manufactured in one mold need not be transferred separately to another mold in which the carrier is formed, which would essentially complicate the method.

In such a two-step injection-molding process it is found to be very advantageous if in the first process step at least one knob-shaped projection is molded on the slats, which projection in the second process step abuts against the wall of the mold for said second process step which is spaced from the slats, to position the slats during said second process step. This precludes warping or displacement of the slats during the second process step. In a shutter manufactured in accordance with such a method the knob-shaped projections mold on the slats projects through apertures in the carrier, so that the connection of the slats to the carrier is further improved, in particular in the sliding direction of the shutter.

In a two-step injection-molding method as described above it is also found to be advantageous if on its wall which is spaced from the slats the mold for the second process step is provided with at least one knob-shaped mold projection at the location of each slat which mold projection abuts against the slat during said second process step to position said slat. This also precludes warping or displacements of the slats during the second process step. The carrier of the finished shutter is then formed with openings of the locations of abutment for the slats.

In this respect it is further found to be advantageous if the two methods are combined, the knob-shaped projection moulded on the slats in the first process step abutting against the knob-shaped mold-projection on the mold for the second process step during said second process step. In this way it is achieved that the knob-shaped projections on the slats do not project from the openings formed in the carrier, but engage only partly in these openings, which may be desirable, for example, for design reasons, and which further improves the connection between the slats and the carrier, in particular in the sliding direction of the shutter.

BRIEF DESCRIPTION OF THE DRAWING

Some embodiments of the invention will now be described in more detail, by way of example, with reference to the accompanying drawings.

DETAILED DESCRIPTION OF THE INVENTION

Figure 1:
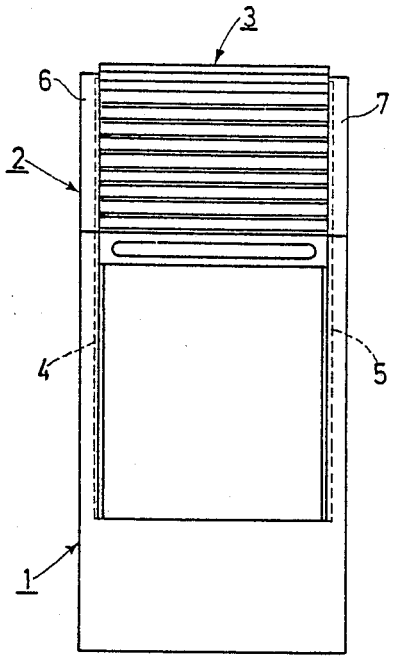
FIG. 1 shows a dry-shaving apparatus with a shutter covering the shear foil.
Figure 2:
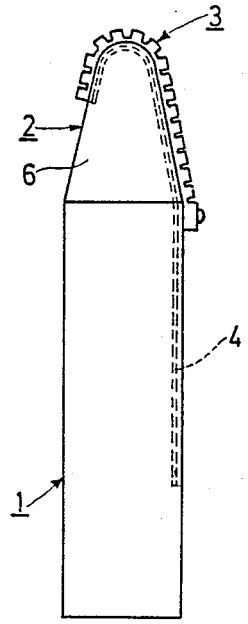
FIG. 2 is a side view of the dry-shaving apparatus shown in FIG. 1.
Figure 3:
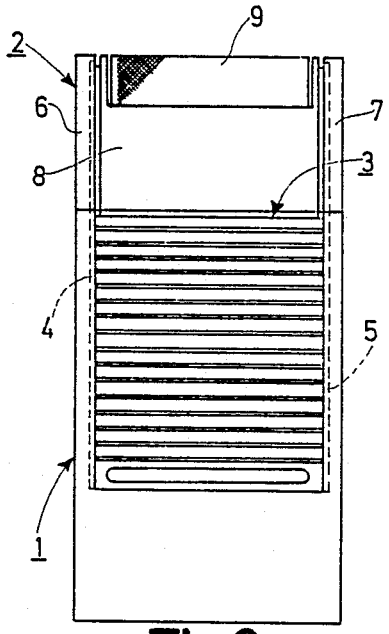
FIG. 3 shows the dry-shaving apparatus of FIG. 1 with the shear foil exposed by the shutter.

FIGS. 1 and 2 show a dry-shaving apparatus comprising a basic apparatus 1 on which a shaving-head frame 2 is mounted. The shaving-head frame 2 is detachably secured to the basic apparatus in a manner not shown, for example by means of at least one resilient latch. Such a shaving-head frame serves for holding an arcuate shear foil, which in the situation illustrated in FIGS. 1 and 2 is covered completely by a shutter 3 to protect the shear foil when the dry-shaping apparatus is not in use. Such a shutter is longitudinally slidable on the dry-shaving apparatus, the shutter being laterally guided at both sides in groove-shaped guides 4 and 5 in the dry-shaving apparatus, which guides are indicated in broken lines in FIGS. 1 and 2. As can be seen, the shutter 3 can be slid from the basic apparatus onto the shaving-head frame 2 and the shear foil, for which purpose the shutter guides 4 and 5 in the basic apparatus 1 are continued in the side walls 6 and 7 of the shaving-head frame 2, where they are curved in conformity with the curvature of the shear foil. If the dry-shaving apparatus is to be used, the shutter is slid from its position shown in FIGS. 1 and 2 onto the basic apparatus 1 to expose the shear foil for the purpose of shaving, as is shown in FIG. 3, where it has been slid back so far that it is also clear of the shaving-head frame 2, enabling said frame to be removed from the basic apparatus 1, for example for cleaning purposes or for replacing the shear foil 9 which is retained by means of the cross-members 8 of the shaving-head frame 2. Such a shutter is required to have a satisfactory stability in the transverse direction, so as to provide adequate protection for the shear foil, and also to have a satisfactory flexibility in the longitudinal direction, so as to enable it to adapt itself to the shape of a shear foil even if it has a comparatively sharp curvature. In order to meet such requirements the shutter comprises an elastic carrier and spaced apart slats connected to the carrier.

Figure 4:
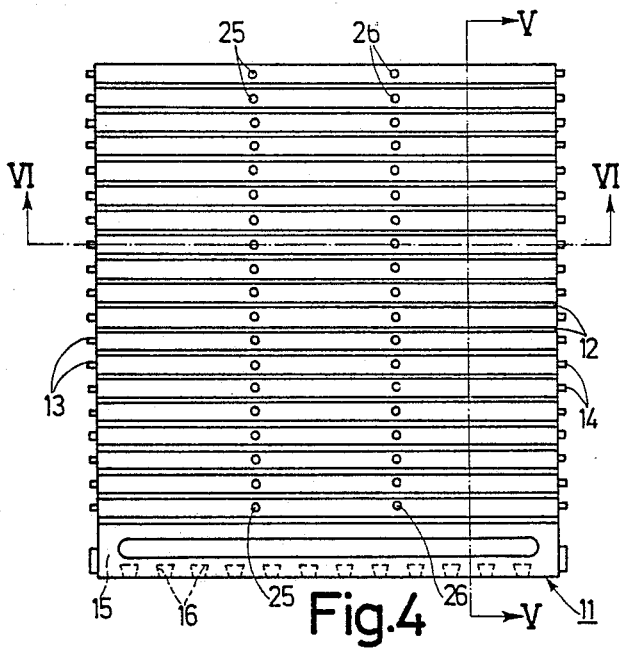
FIG. 4 is a plan view of a first embodiment of a shutter manufactured in accordance with the inventive method, which shutter comprises an elastic carrier to which spaced-apart slats are connected, the carrier enveloping the slats over their full height in a meandering pattern and the carrier portions between the slats being formed as articulate thin portions.
Figure 5:
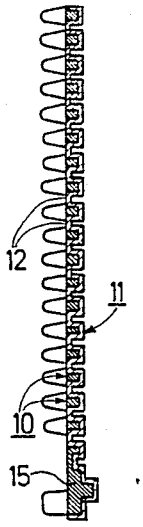
FIG. 5 shows the shutter in a sectional view taken on the line V—V in FIG. 4.
Figure 6:
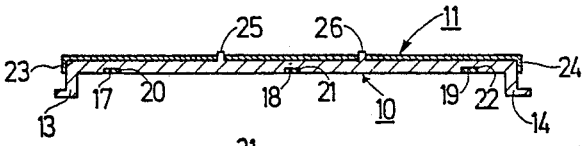
FIG. 6 shows the shutter in a sectional view taken on the line VI—VI in FIG. 4.

FIGS. 4, 6 and 6 show an embodiment of such a shutter 3 in detail. The slats 10, which are spaced apart and extend across the full width of the shutter, are inherently stiff, which can be achieved by an applicable choice of their cross-sectional shape and material, in order to ensure that the shutter has a satisfactory transverse stability. These slats 10 are connected to a carrier 11 which is comparatively thin and which is made of an elastic material to provide the longitudinal flexibility of the shutter. The slats 10 are connected to the carrier 11 in such a way that, viewed in the longitudinal direction of the shutter, the slats are successively enveloped by the carrier in a meandering pattern at sides adjoining each other in a U-shape. In the present case the carrier 11 envelops the slats 10 in a meandering pattern over their full height, as is shown in FIG. 5. The portions 12 of the carrier 11 between the spaced-apart slats 10 are formed as articulate thin portions of the integral-hinge type, which provides a very good longitudinal flexibility of the shutter. Since the carrier envelops the slats over their full height as stated above, a reliable connection of the slats to the carrier is obtained. Moreover, the portions 12 of the carrier 11 between the slats 10 together with these slats 10 are constructed in such a way that at this side the shutter has a flush wall surface, which is very suitable as a contact surface for the shutter on the dry-shaving apparatus.

At their ends the slats 10 comprise stiff lateral projections 13 and 14 which in the present case are L-shaped and project from the slats in a direction transverse to the shutter and away from the carrier 11. The free ends of these projections 13 and 14 serve for guiding the shutter in groove-shaped guides 4 and 5 on the dry-shaving apparatus. Since these projections 13 and 14 as well as the slats 10 are stiff, a very effective and reliable guidance for the shutter is obtained. Since the projections 13 and 14 as well as the slats 10 are spaced apart, the shutter can also follow comparatively sharp curvatures of the guides 4 and 5, as may be the case at the location of the shear foil. This is promoted by the fact that the articulate thin portions 12 are situated at full-height level of the slats 10, so that for the stiff parts of the shutter, hinge axes are formed which are located so as to allow the shutter to follow the lateral guides 4 and 5 in the appropriate manner, its stiff parts being freely pivotable relative to each other. Moreover, as a result of the L-shape of the projections 13 and 14, the lateral guides 4 and 5 are offset from the shutter, so that the side walls 6 and 7 of the shaving-head frame, in which walls the guides 4 and 5 are formed, need not project above the shear foil at this location, as can be seen in FIG. 3. The offset of the guides 4 and 5 relative to the shutter then corresponds to the length of the limbs of the L-shaped projections 13 and 14 on the slats 10. Thus, the side walls 6 and 7 of the shaving-head frame do not project above the shear foil 9 and, consequently, do not hamper shaving.

To enable the shutter to be moved conveniently by hand, the last slat which is situated at one end of the shutter, viewed in the longitudinal direction of the shutter, and which is most remote from the shear foil when the shutter is in its position on the basic apparatus, is widened to form a gripping element 15. Further, this slat constituting a gripping element 15 is formed with undercut lateral grooves 16 which extend transversely of said element, the carrier 11 enveloping said slat engaging in said grooves. This provides a very reliable connection of the gripping element to the carrier, which is capable of taking up forces as they occur during operation of the shutter, in particular those acting in the sliding direction.

In order to make the connection of the slats 10 to the carrier 11 even more stable, the carrier at the side where the slats 10 are free from the U-shaped envelopment by the carrier, is provided with continuous ribs 17, 18 and 19 which are spaced apart and which extend in the longitudinal direction of the shutter, as can be seen in FIG. 6. In the present case these ribs engage in groove-shaped recesses 20, 21 and 22 in the free sides of the slats 10, so that the slats 10 are anchored reliably to the ribs 17, 18 and 19 of the carrier 11. Thus, the ribs 17, 18 and 19 of the 19 of the carrier 11 in conjunction with the salts 10, which are partly enveloped at both sides by the carrier, brace the shutter, thereby strengthening the connection between the slats and carrier and improving the stability of the complete shutter.

Furthermore, it is to be noted that in the present embodiment, as can be seen in FIG. 6, the two ends of the slats 10 are partly enveloped by tab-like portions 23 and 24 of the carrier 11. This step also serves to improve the connection between the slats 10and the carrier 11.

Figure 7:
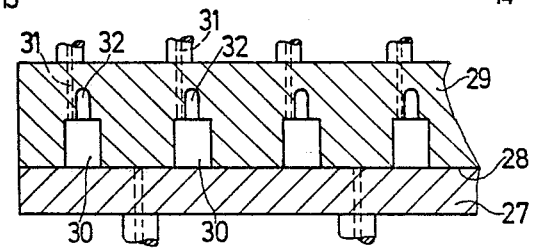
FIG. 7 shows a mold used in a first process step for manufacturing a shutter as shown in FIG. 4.
Figure 8:
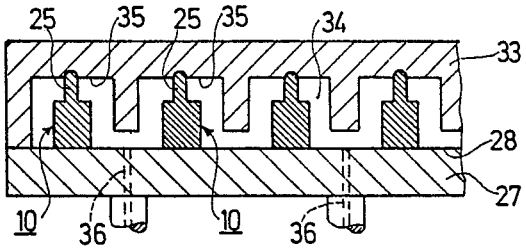
FIG. 8 shows a mould used in a second process step for manufacturing a shutter as shown in FIG. 4.

For manufacturing a shutter 3 as described above it is to be found to be simple and advantageous to use a two-step injection-molding process, during which the slats 10 are formed in the first process step and the carrier 11 is formed in the second process step. In the present case, two spaced-apart knob-shaped projections 25 and 26 are molded on each slat in the first process step, which projections are also visible on the finished shutter, as can be seen in FIGS. 4 and 6. A mold used for such a first process step is shown diagrammatically in FIG. 7. It comprises a first mold half 27 having a supporting surface 28 for a second mold half 29 having recesses 30 for the formation of the individual slats 10, in which recesses injection ducts 31 terminate. To form the knob-shaped projections 25 and 26 on the slats 10 two further recesses are formed at the relevant locations in the recesses 30, of which a recess 32 is shown in FIG. 7. After molding of the slats 10 the second mold half 29 is removed, so that the slats 10 remain on the first mold half 27. Subsequently, as is illustrated diagrammatically in FIG. 8, a further mold half 33 is placed on the mold half 27, which further mold half has a continuous recess 34 corresponding in shape to the carrier 11. The knob-shaped projections 25 and 26 molded on the slats 10 in the first process step, of which one projection 25 is visible in FIG. 8, then abut against the wall 35 of the further mold half 33, which wall is clear of the slats 10. Thus, the slats 10 are positioned and retained in the mold for the second process step. Subsequently, the carrier 11 is molded via the injection ducts 36 in the first mold half 27. As during this process the individual slats 10 are so positioned in the mold for the second process step by means of their knob-shaped projections 25 and 26 that they cannot be displaced or warped, the carrier 11 can be molded around the slats 10 in a correct and reliable manner, yielding a reliable and stable connection of the slats 10 to the carrier 11. In a shutter manufactured in accordance with such a method the knob-shaped projections 25 and 26 molded on the slats 10 extend through the openings formed in the carrier 11. When the knob-shaped projections 25 and 26, as they abut against the wall 35 of the further mold half 33, engage in recesses formed in said wall, as in the present case illustrated in FIG. 8, the projections 25 and 26 will protrude from the openings formed in the carrier 11, as can be seen in FIG. 6. This results in an even better positioning of the slats 10 in the mold for the second process step, and the connection of the slats 10 to the carrier 11 is strengthened additionally, in particular in the sliding direction of the shutter.

Figure 9:
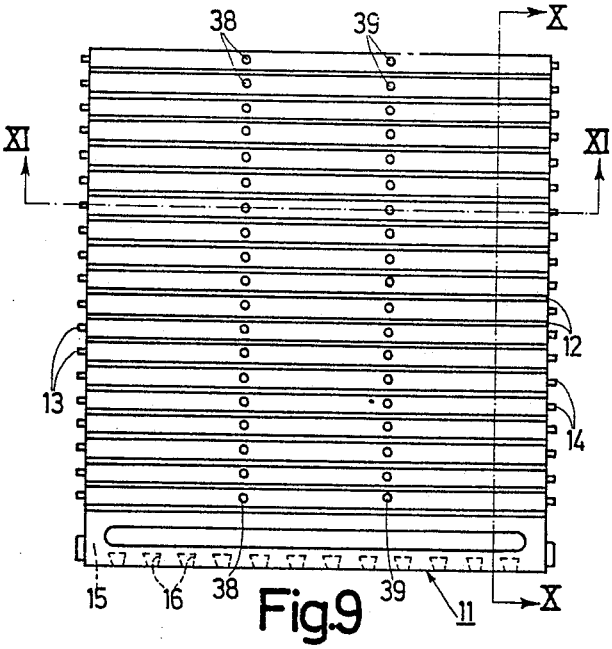
FIG. 9 is a plan view of a shutter of the same construction as the embodiment of FIG. 4, manufactured by means of another inventive method.
Figure 10:
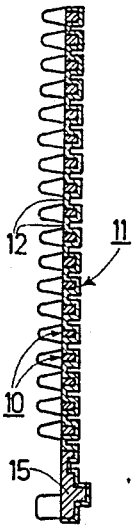
FIG. 10 shows the shutter in a sectional view taken on the line X—X in FIG. 9.
Figure 11:
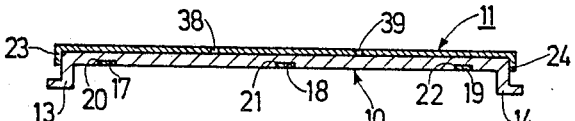
FIG. 11 shows the shutter in a sectional view taken on the line XI—XI in FIG. 9.
Figure 12:
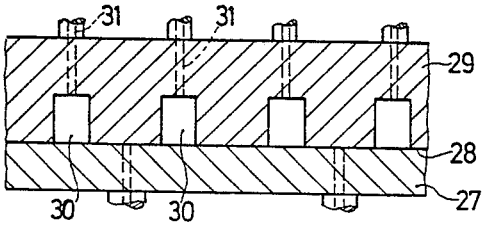
FIG. 12 shows a mold used in a first process step for manufacturing a shutter as shown in FIG. 9.
Figure 13:
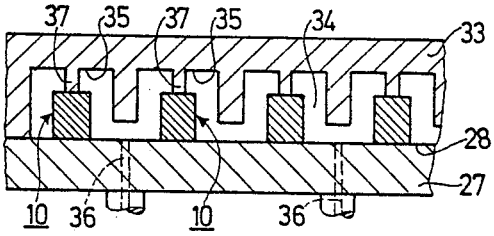
FIG. 13 shows a mold used in a second process step for manufacturing a shutter as shown in FIG. 9.

The shutter shown in FIGS. 9, 10 and 11 is of substantially the same construction as the shutter shown in FIGS. 4, 5 and 6 but it is manufactured by means of another two-step injection-moulding process, in which the slats 10 are again formed in the first process step and the carrier 11 in the second process step. However, in the present case the slats 10 are formed without knob-shaped projections in the first process step. A mold suitable for such a first process step is shown diagrammatically in FIG. 12. Again it comprises a first mold half 27 having a supporting surface 28 for a second mold half 29, recesses 30 in which injection ducts 31 terminate being provided to form the individual slats 10. After the slats 10 have been molded in this mold, the second mold half 29 is removed, the slats 10 remaining on the first mold half 27. Subsequently, as is shown diagrammatically in FIG. 13, a further mold half 33 is placed on said first mold half 27, which further mould half is formed with a continuous recess 34 corresponding in shape to the carrier 11. The wall 35 of this recess 34 is provided with two spaced-apart knob-shaped mold projections at the location of each slat 10, of which a projection 37 at the location of each slat 10 is shown in FIG. 13. These knob-shaped mold projections 37 abut against the slats 10, so that said projections position and retain these slats in the mold for the second process step to ensure that said slats cannot be displaced or become warped. Subsequently, the carrier 11 is molded through injection ducts 36 of the first mold half 27. As during this operation the individual slats 10 are positioned in the mold for the second process step by means of the knob-shaped mold projections 37 on the further mould half 33, moulding the carrier 11 around the slats 10 proceeds in a correct and reliable manner, yielding a reliable and stable connection between the slats 10 and the carrier 11. In a shutter manufactured by means of such a method, the carrier 11 has openings, 38 and 39 (see FIGS. 9 and 11), at the locations where knob-shaped mold projections 37 are situated during the manufacture of the carrier.

Figure 14:
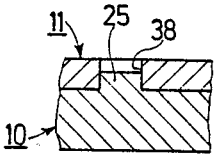
FIG. 14, in a view similar to FIG. 11, shows a part of a shutter as obtained when the methods of manufacturing a shutter as shown in FIG. 4 and a shutter as shown in FIG. 9 are combined.

If, for example for design reasons, it is not desirable that the knob-shaped projections 25 and 26 molded on the slats 10 protrude from the openings formed in the carrier 11, as in the method used for manufacturing the shutter shown in FIGS. 4, 5 and 6, but it is nevertheless desirable to strengthen the connection of the slats 10 to the carrier 11 by means of knob-shaped projections 25 and 26 engaging the openings in the carrier 11, such a method may be combined with the method of manufacturing the shutter shown in FIGS. 9, 10 and 11. In the first process step knob-shaped projections 25 and 26 are again molded on the slats 10, but in the mold for the second process step these projections abut against knob-shaped mould projections 37 provided on the wall 35 of the further mold half 33. In this way the individual slats 10 are again positioned and retained in the mold for the second process step, so that the carrier is molded around the slats in a correct and reliable manner. However, since the knob-shaped projections 25 and 26 on the slats 10 then engage only partly in the openings 38 and 39 formed in the carrier 11, the connection between the slats 10 and the carrier 11 is strengthened additionally. FIG. 14, in the same way as FIG. 11, shows a part of a shutter thus manufactured, having a knob-shaped projection 25 molded on the slat 10 which, as can be seen, engages only partly in the opening 38 formed in the carrier 11.

Figure 15:
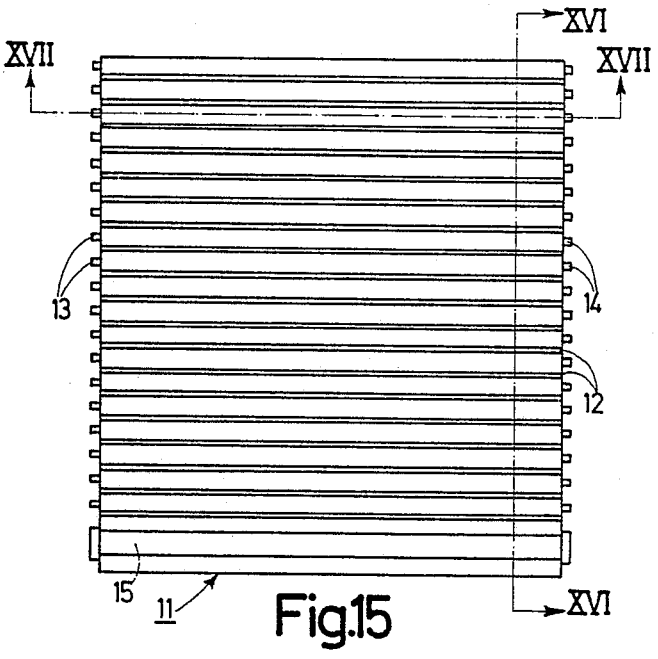
FIG. 15 is a plan view of a shutter of a construction similar to that of the embodiment shown in FIG. 4, in which the carrier envelops the slats only over a part of their height in a meandering pattern.
Figure 16:
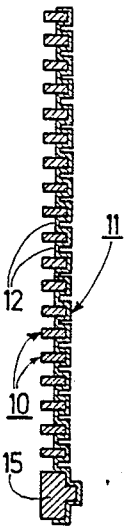
FIG. 16 shows the shutter in a sectional view taken on the line XVI—XVI in FIG. 15.
Figure 17:
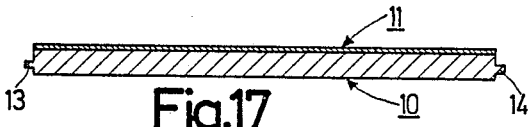
FIG. 17 shows the shutter in a sectional view taken on the line XVII—XVII in FIG. 15.

The shutter as shown in FIGS. 15, 16 and 17 is of a construction similar to that of the shutter in the embodiment shown in FIGS. 4, 5 and 6. As can be seen in FIG. 16, the carrier 11 successively envelops the slats 10 not over their full height but only over a part of their height in a meandering pattern. The portions 12 of the carrier 11 constituting the articulate thin portions are therefore situated at substantially half the height of the slats 10, so that said slats partly project from the carrier 11. During fabrication of such a shutter the parts of the slats 10 projecting from the carrier 11 may be used for positioning the slats 10 in a mold for manufacturing the carrier 11, because at these locations the mold must have recesses in which the slats 10 are engageable. In the present embodiment, as can be seen in FIG. 17, the projections 13 and 14 at the ends of the slats 10 for laterally guiding the shutter at both sides in groove-shaped guides 4 and 5 in the dry-shaving apparatus are simply constructed as cylindrical pins projecting from the ends of the slats 10.

Figure 18:
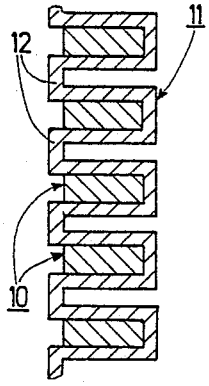
FIG. 18, in a view similar to FIG. 16, shows a shutter in which the carrier envelops the slats over their full height in a meandering pattern.

In the case of the shutter shown in FIG. 18 the carrier 11 successively envelops the slats 10 over their full height in a meandering pattern, the articulate thin protions 12 of the carrier 11 then being situated beyond the slats 10. Thus, if desired, the hinge axes for the stiff parts of the shutter can be situated beyond the location of the slats 10.

Figure 19:
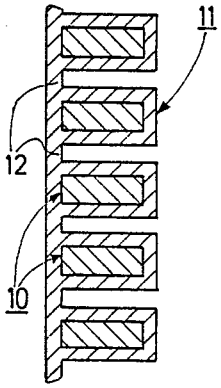
FIG. 19, in a view similar to FIG. 16, shows a shutter in which the slats are enveloped completely by the carrier, and the portions of the carrier between the slats constitute articulate thin portions situated at full-height level of the slats.

FIG. 19 shows a shutter of a construction which is similar to the shutter in the embodiment shown in FIG. 17 but in which the slats 10 are enveloped completely by the carrier 11. In this way the slats 10 are inseparably connected to the carrier 11, which results in a very high stability of such a shutter despite a satisfactory longitudinal flexibility.

Figure 20:
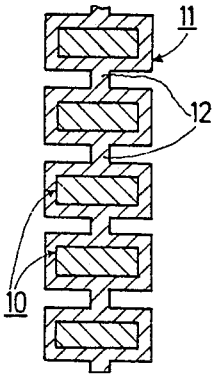
FIG. 20, in a view similar to FIG. 16, shows a shutter constructed in the same way as the embodiment shown in FIG. 18, in which the articulate thin portions formed by the carrier are situated at half the height of the slats.

In the embodiment shown in FIG. 20, in the same way as in the embodiment shown in FIG. 19, the slats 10 are also enveloped completely by the carrier 11, but the portions 12 of the carrier 11 forming the articulate thin portions are now situated at substantially half the height of the slats 10. In such an embodiment of the shutter the shutter can be arranged on the dry-shaving apparatus in such a way that it is irrelevant which of its wall surfaces faces the apparatus.

Figure 21:
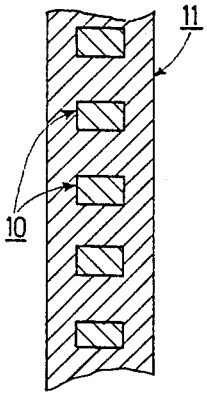
FIG. 21, in a view similar to FIG. 16, shows a shutter in which the slats are enveloped completely by a carrier in the form of a strip.

FIG. 21 shows a shutter in which the slats 10 are again enveloped completely by the carrier 11, but in which the carrier 11 is formed as a strip having flat wall surfaces. Such a shutter may be used if the lateral guides on the dry-shaving apparatus only have a comparatively moderate curvature corresponding to a shear foil of comparatively moderate curvature.

The choice between these different embodiments of a shutter can be made to suit specific requirements. It is obvious that, within the scope of the present invention, a series of further modifications of the embodiments describe in the foregoing are possible to obtain a shutter for optionally covering or exposing a shear foil of a dry-shaving apparatus. In this respect it is to be noted that the cross-sectional shape of the slats is arbitrary. For example, the cross-sectional shape for the slats may also be trapezoidal, triangular or circular.

What is claimed is:

1. A shutter for a dry-shaving apparatus on which it is arranged longitudinally slidable for optionally covering or exposing a shear foil of said apparatus, which shutter comprises an elastic carrier and spaced-apart slats and can be guided laterally at both sides in groove-shaped guides provided on the dry-shaving apparatus, wherein the slats are successively enveloped in the longitudinal direction of the shutter at least partly by the elastic carrier.

2. A shutter as claimed in claim 1, wherein the slats are successively enveloped by the carrier in a meandering pattern at sides adjoining each other in a U-shape, the portions of the carrier between the spaced-apart slats being formed as articulate thin portions of the integral-hinge type.

3. A shutter as claimed in claim 2, wherein the slats are enveloped by the carrier in a meandering pattern at least over their full height.

4. A shutter as claimed in claim 2 or 3, wherein at the side where the slats are free from the U-shaped envelopment by the carrier, the carrier comprises at least one continuous rib which extends in the longitudinal direction of the shutter.

5. A shutter as claimed in claim 4, wherein the rib engages in groove-shaped recesses formed in the free sides of the slats.

6. A shutter as claimed in claim 1 wherein the slats are enveloped completely in the longitudinal direction of the shutter by the carrier, the portions of the carrier between the spaced-apart slats being formed as articulate thin portions of the integral-hinge type.

7. A shutter as claimed in claim 1 wherein the slats are enveloped completely in the longitudinal direction of the shutter by the carrier and the carrier is constructed as a strip having flat wall surfaces.

8. A shutter as claimed in claim 1, wherein the slats extend across the full width of the shutter and at their ends comprise stiff lateral projections with which the shutter can be guided laterally at both sides in groove-shaped guides on the dry-shaving apparatus.

9. A shutter as claimed in claim 8, wherein the projections are L-shaped and project from the slats transversely of the shutter.

10. A shutter as claimed in claim 8 or 9, wherein the ends of the slats are laterally enveloped at least partly by the carrier.

11. A shutter as claimed in wherein, the last slat situated at one end of the shutter is constructed as a widened gripping element for moving the shutter.

12. A shutter as claimed in claim 11 wherein the carrier which envelops the slat constituting a gripping element engages in lateral grooves formed in said slat and extending transversely of the slat.

13. A shutter as claimed in claim 12 wherein the lateral grooves in the slat constituting a gripping element are undercut.

14. A method of manufacturing a shutter as claimed in claim 1, characterized in that the slats and the carrier are manufacture in a two-step injection-moulding process, the slats being formed in the first process step and the carrier being formed in the second process step.

15. A method as claimed in claim 14, characterized in that in the first process step at least one knob-shaped projection is moulded on the slats, which projection in the section process step abuts against that wall of the mould for said second process step which is spaced from the slats, to position the slats during said second process step.

16. A method as claimed in claim 14, characterized in that on its wall which is spaced from the slats the mould for the second process step is provided with at least one knob-shaped mould projection at the location of each slat, which mould projection abuts against the slat during said second process step to position said slats.

17. A method as claimed in claim 15, characterized in that, the knob-shaped projection moulded on the slats in the first process step abutting against the knob-shaped mould projection on the mould for the second process step during said second process step.

* * * * *